US009431779B1

(12) United States Patent
Abbisso, Jr.

(10) Patent No.: US 9,431,779 B1
(45) Date of Patent: Aug. 30, 2016

(54) EXTENSION CORD LIGHT SOURCE

(71) Applicant: Leonard J. Abbisso, Jr., Dedham, MA (US)

(72) Inventor: Leonard J. Abbisso, Jr., Dedham, MA (US)

( * ) Notice: Subject to any disclaimer, the term of this patent is extended or adjusted under 35 U.S.C. 154(b) by 169 days.

(21) Appl. No.: 14/261,471

(22) Filed: Apr. 25, 2014

(51) Int. Cl.
*H01R 13/717* (2006.01)

(52) U.S. Cl.
CPC ..... *H01R 13/7175* (2013.01); *H01R 13/717* (2013.01)

(58) Field of Classification Search
CPC ..... H01R 13/717; H01R 13/7172; H01R 13/7175; H01R 13/7177
See application file for complete search history.

(56) References Cited

U.S. PATENT DOCUMENTS

| | | | | |
|---|---|---|---|---|
| 1,633,344 | A | 12/1926 | Moran | |
| 2,023,283 | A | 3/1934 | Novy | |
| 3,814,927 | A | 6/1974 | Buzza | |
| 4,574,220 | A | 3/1986 | Tate | |
| D298,657 | S | 11/1988 | Flores | |
| 5,742,466 | A * | 4/1998 | Kram | H01R 25/00 361/111 |
| 7,274,153 | B2 | 9/2007 | Miller et al. | |
| 7,387,403 | B2 | 6/2008 | Mighetto | |
| 2006/0039136 | A1 | 2/2006 | Probasco et al. | |
| 2007/0159772 | A1 * | 7/2007 | Morice | H01R 13/60 361/600 |
| 2013/0258661 | A1 | 10/2013 | Jousse et al. | |
| 2014/0036517 | A1 | 2/2014 | Machiorlette | |

FOREIGN PATENT DOCUMENTS

| | | | | |
|---|---|---|---|---|
| CA | 2039090 | * 10/1995 | ..... | H01R 13/717 |

* cited by examiner

*Primary Examiner* — Stephen F Husar
(74) *Attorney, Agent, or Firm* — Stan Collier, Esq.

(57) ABSTRACT

An extension cord light source provides a source of light without additional cords or light units. A light source is attached or attachable to the end of an extension cord. The light source may be a light bulb-shaped source having multiple LEDs therein. Clear plastic encloses the devices therein and allows for multi-directional light beams. The LEDs may connected to a switch with multiple positions for controlling the amount of light. The extension cord lines pass through the bulb and into an outlet being a female plug. This combination thus eliminates the need for a drop light. A removable shade may be also attached to the bulb to prevent unnecessary light. A pilot lamp is included in the bulb to indicate that the power is present. The bulb may have a male plug therein that will accept the female plug of a conventional extension cord.

12 Claims, 6 Drawing Sheets

EXTENSION CORD LIGHT SOURCE

CROSS REFERENCES TO RELATED APPLICATIONS

NA

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

1. Field of the Invention

The present invention relates generally to lighting devices, and, more particularly, relates to the lighting devices that are portable, and, in greater particularity, relates to lighting devices that are attached or attachable to extension cords.

2. Description of the Prior Art

Portable lighting devices and extension cords are a necessity in construction work whether at home or in a commercial setting. The power to a particular area may be disconnected to outlets for various reasons and thus the extension cord is necessary as well as a portable light source such as with a drop light. As a result, there may be numerous cords on the floor presenting a tripping hazard or even an electrical hazard.

Extension cords come in a wide variety of sizes from a simple lamp cord having two wires to heavy duty commercial cords with three wires. The wire gauge changes to support different loads. There may be multiple outlets and the covering may be thicker to prevent cutting, cracking, or even burning. U.S. Patent Application 2006/0039136 discloses an electrical cord with a male plug with a forward pointing light source having an independent power source and a switching means therein. Further there are female plugs having a pilot light therein for indicating power.

U.S. Pat. No. 3,814,927 discloses a conventional drop light having a conventional incandescent light bulb in a housing with a switch. A partial hood is attached to the base of the light with a hinged gate guard. A hook at the top allows the light to be placed where appropriate. U.S. Pat. No. 7,274,153 discloses a hand-held fluorescent lamp with a female outlet in the handle. Design Pat. 298,657 discloses a lamp with an extending cord with a male plug for attachment to an extension cord and a female plug for additional extension cords thereon. The use of LEDs instead of fluorescent lamps or incandescent lamps is used on numerous lighting sources from desktop lamps to operating room lighting devices such as shown in U.S. Patent Application 2013/0258661 or U.S. Pat. No. 7,387,403. LED dimmer switches and lighting with LEDs is also shown in U.S. Pat. No. 8,593,079 and U.S. Pat. No. 7,387,403. These patent references are incorporated by reference.

Accordingly, there is a need for a lighting device that cooperates with extension cords.

SUMMARY OF THE INVENTION

The present invention provides a light source that cooperates with an extension cord or other power sources to minimize cords and/or cables.

An extension cord light source provides a source of light without additional cords or light units. A light source is attached or is attachable to the end of an extension cord. The light source may be bulb shaped source having multiple LEDs therein and enclosed in clear plastic housing and allows for multi-directional light beams. The LEDs are connected to a switch with multiple positions for controlling the amount of light. The extension cord lines pass through the bulb and into an outlet being at least one female plug. This combination thus eliminates the need for a drop light when an extension cord is required. A removable hood/shade may be also attached to the bulb to prevent unnecessary light. A pilot lamp is included in the bulb to indicate that the power is present and also provides a minimal light source until the bulb is activated. The bulb may have a male plug therein that will accept the female plug of a conventional extension cord and thus the light source can be removed if unnecessary and/or placed in another location.

An object of the present invention is to provide light source for use with an extension cord.

Another object of the present invention is to provide the light source that uses multiple LEDs for use with an extension cord.

A further object of the present invention is to provide the light source that uses LEDs and can be removed from an extension cord and be connected to other power sources.

A still further object of the present invention is to provide the light source that has a manually adjustable light source.

A yet still further object is to provide the light source that can be attached to a light fixture such as a lamp or another power source.

These and other objects, features, and advantages of the present invention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

The present invention provides a light source that cooperates with an extension cord or other power sources to minimize cords and/or cables, and provides maximum utility.

In general, an extension cord light source provides a source of light without additional cords or light units. A light source is attached or attachable to the end of an extension cord. The light source may be a light bulb-shaped source having multiple LEDs therein. Clear plastic encloses the devices therein and allows for multi-directional light beams. The LEDs are connected to a switch with multiple positions for controlling the amount of light or just an on-off switch. The extension cord lines can pass through the bulb and into an outlet being a female plug. This combination thus eliminates the need for a drop light. A removable shade may also be attached to the bulb to prevent unnecessary light. A pilot lamp is included in the bulb to indicate that the power is present and also provides a minimal light source until the bulb is activated. The bulb may have a male plug therein that will accept the female plug of a conventional extension cord and thus the light source can be removed if unnecessary.

Figure 1:
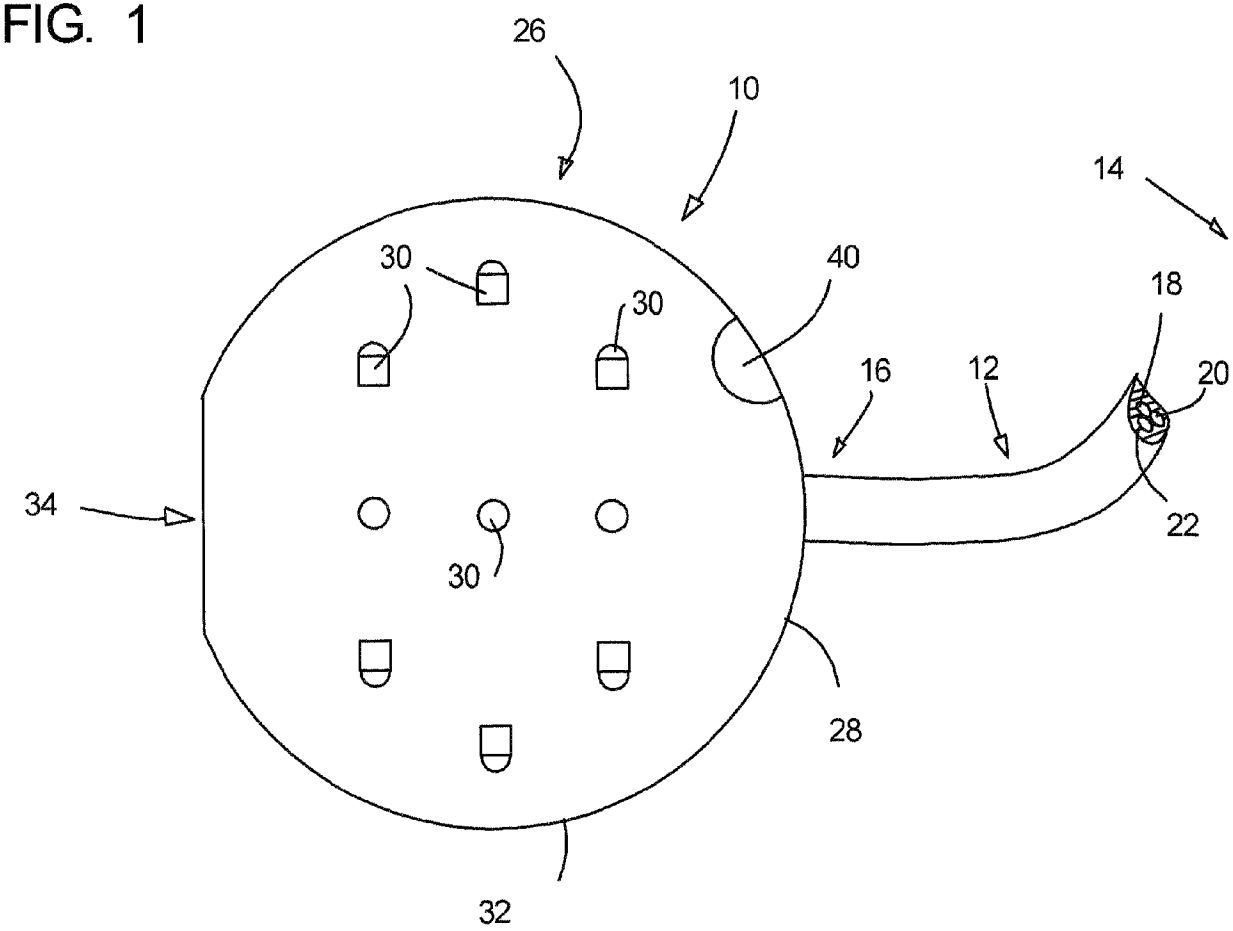
FIG. 1 illustrates by side view an extension cord light source of the present invention.

Referring to FIG. 1, an improved extension cord light source 10 is shown. An extension cord 12 has a first end 14, not shown, with a male plug thereon and a second end 16 with a female plug as shown herein. The male plug is adapted to plug into a source of power, not shown. The extension cord 12 may have three wires therein, one being for power 22, one being a common 24, and one being a ground 26. An LED light source 26 is connected to the second end 16 of the extension cord 12 and may be a bulb-shaped light source 28 having a plurality of light devices such as LEDs 30 or the like therein. The bulb-shaped light source has a housing 32 substantially composed a durable clear plastic material. The LEDs 30 can be arranged therein to maximize light out. As seen in FIG. 1, the LEDs 30 number 12 with 4 in each plane and separated by 90 degrees. The LEDs are pointing axially, but can also point radially with respect to the cord second end 16. The connected wires are not shown, but are considered conventional and have electrical means for connecting within the light source 26 the plurality of LED light devices 30 to a source of power therein and to a switch 40. At least one female power outlet 34 is connected to the source of power through the wires.

Figure 3:
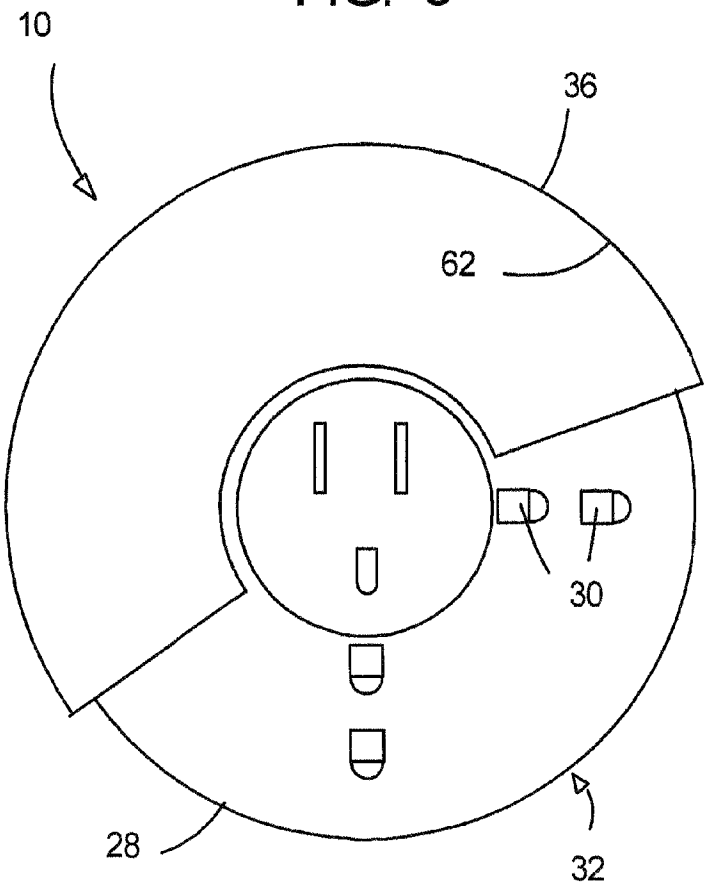
FIG. 3 illustrates by a front end view the extension cord light source of FIG. 2 having a reflecting rotatable hood thereon.
Figure 2:
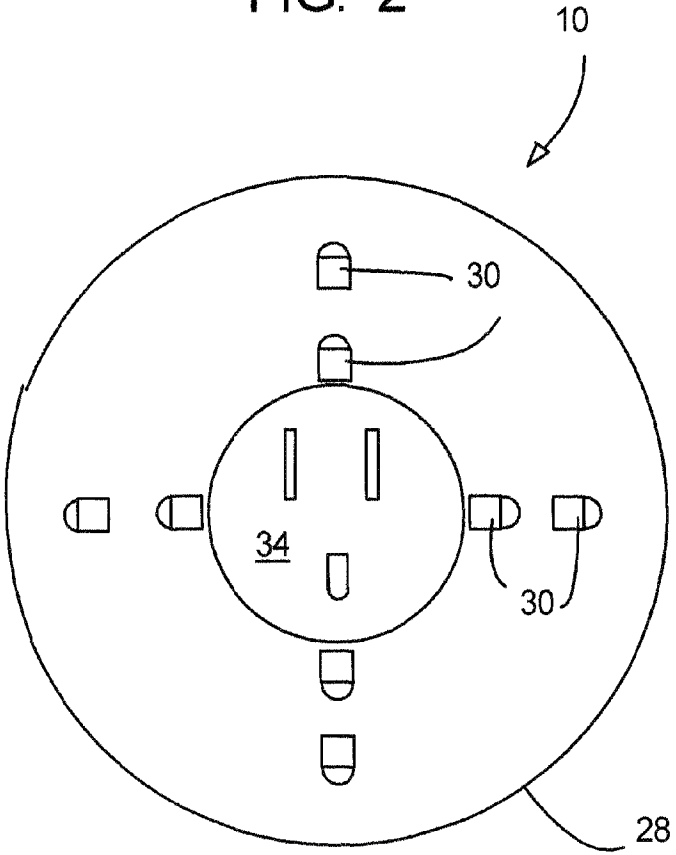
FIG. 2 illustrates by a front end view the extension cord light source of FIG. 1 showing a female outlet.

FIG. 2 shows a front end with the female power outlet 34 as well as the LEDs 30 embedded in clear durable plastic with a particular arrangement, that is only representative of a unique arrangement because many different arrangements are possible within the scope of the invention. FIG. 3 shows the bulb shaped housing 28 with a partial shade/hood 36 that may be rotated about the bulb shaped housing 28 so that the intense light from some of the LEDs 30 may be blocked. Further the shade 36 may have a reflective surface 62 on the inside of the shade 36 and by designing the hood 36 to be just over 180 degrees it may be snapped on and also removed as needed.

Figure 4:
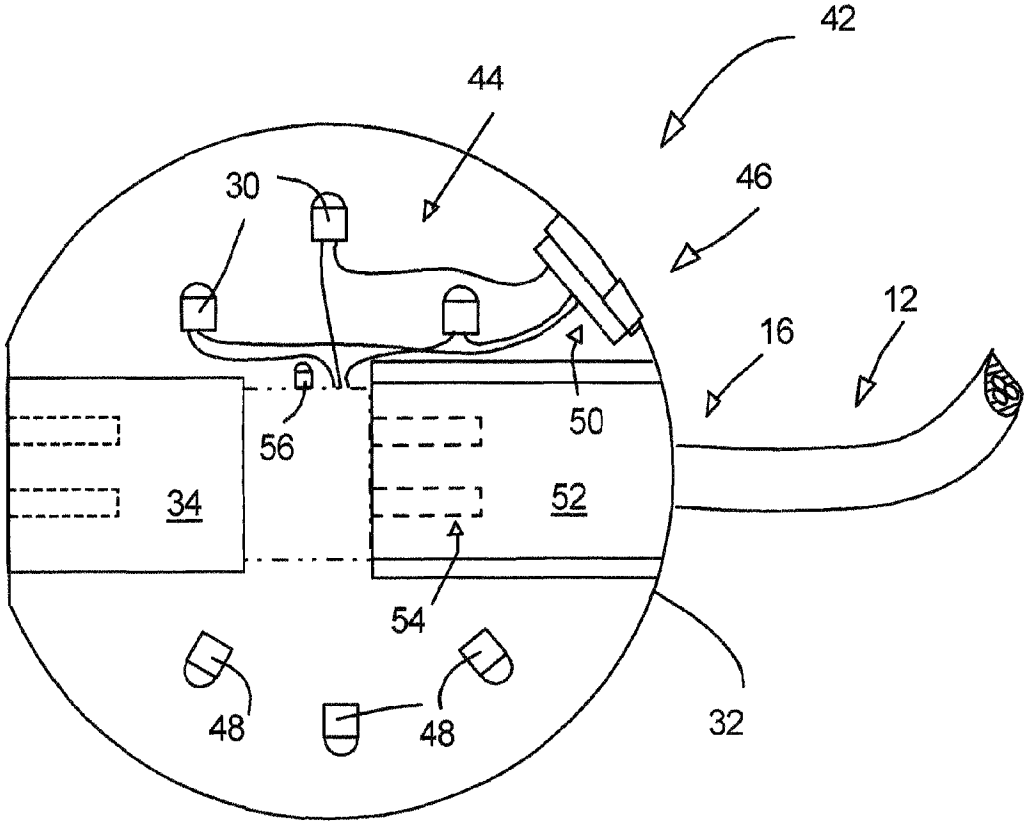
FIG. 4 illustrates by a cross sectional view the internal arrangement of the extension cord light source having a removable female plug on the extension cord.
Figure 5:
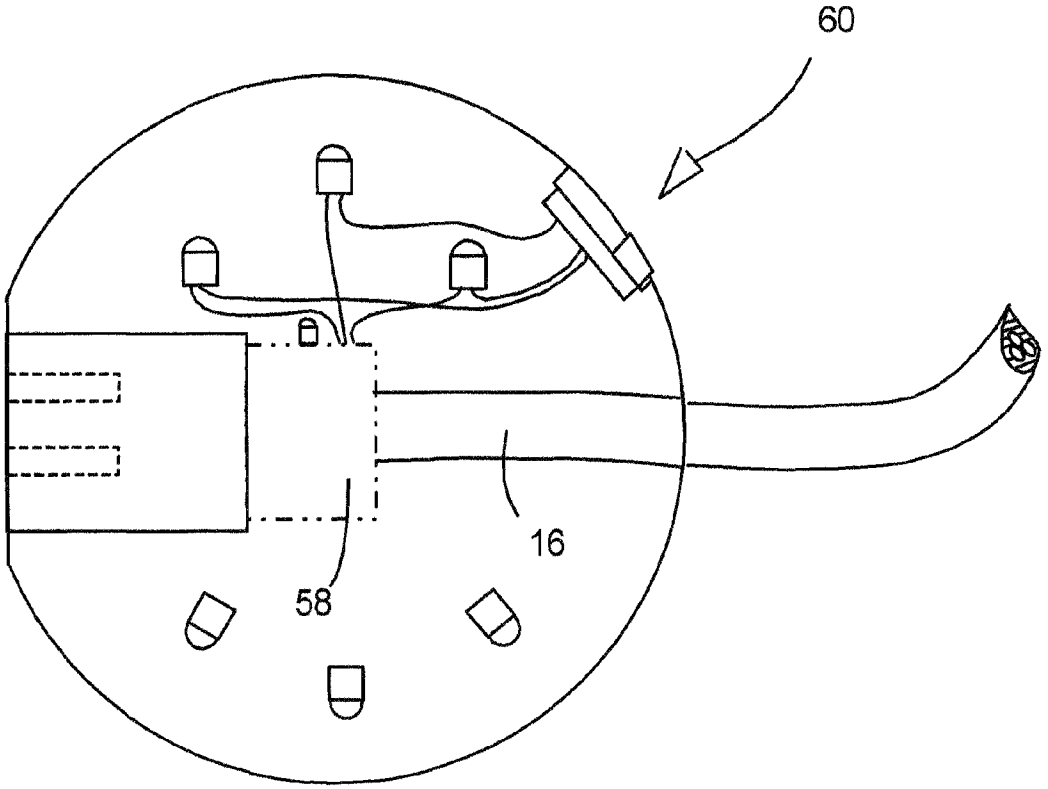
FIG. 5 illustrates by a cross sectional view the internal arrangement of the extension cord light source without female plug on the extension cord of FIG. 4.

FIG. 4 shows an embodiment 42 showing partial wiring from the LEDs 30 to a sliding switch that may have three positions, off, low and high, or even be a dimmer switch, not shown, to adjust the light to a particular level. An alternative LED positioning is shown by LEDs 48 being mounted radially. The housing 32 has a male plug outlet 50 embedded therein with the female outlet 52 removably attached the male pins 54 and the outlet 52 attached to the second end 16 of the cord 12. The female outlet 52 may be fully mounted within the outlet 48. Additionally to the LEDs 30/48, a pilot light 56 may be included to indicate power on to the light source 10. The necessary electronics and wiring may be included in an electrical section 58 and is considered to be conventional. One or more female outlets may be included in the housing 32. FIG. 5 shows a similar source light 60 as FIG. 4 except the cord end 16 is attached directly into the electrical section 58 thus making the light source 60 dedicated to one particular extension cord 12.

Figure 6:
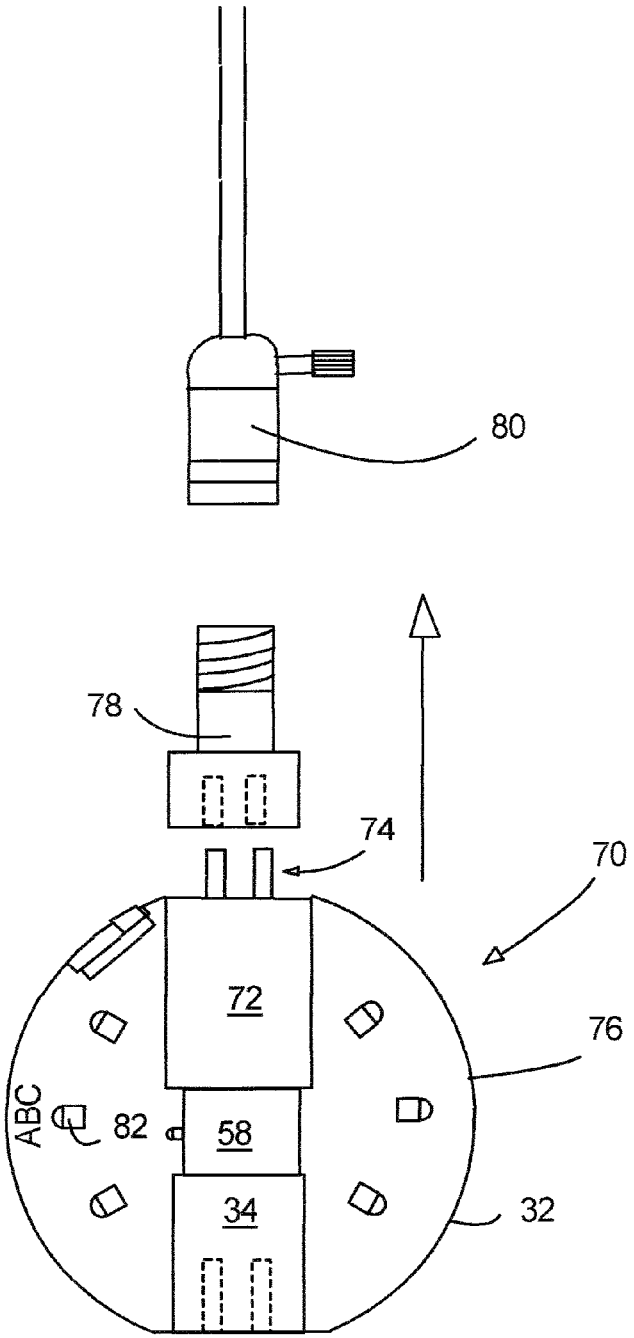
FIG. 6 illustrates extension cord light source plugged into an adapter that can be screwed into a ceiling light outlet.

Referring to FIG. 6, a bulb shaped light source 70 wherein a male plug 72 has pins 74 extending beyond said housing 76 such that the light source 70 is adapted to be plugged into a wall outlet or another extension cord or any outlet or an adapter 78 that can be screwed into a lamp 80 such as may be used in construction and hanging from ceilings.

Figure 7:
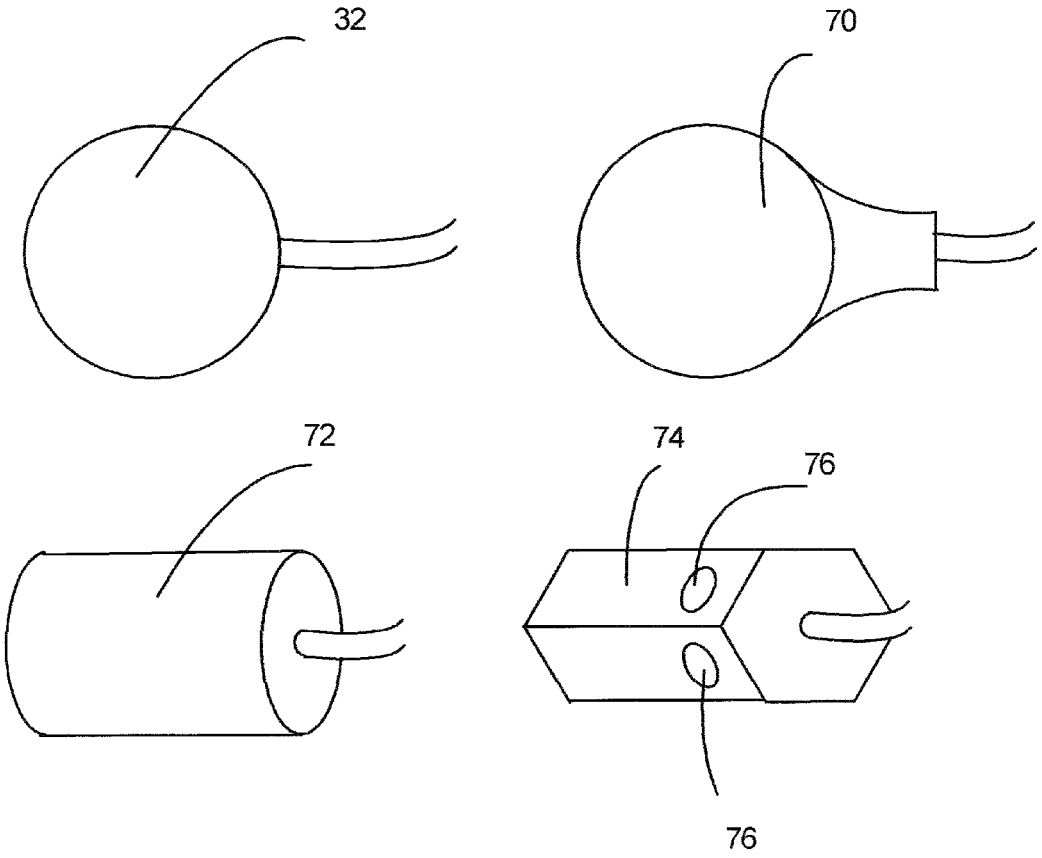
FIG. 7 illustrates various shapes for the housing of the light source.

As an additional benefit one or more of the LEDs 82 may be used to illuminate a logo or company name "ABC" or such on the outside of the housing 32. FIG. 7 illustrates only a few of the possible different shapes of housings 32, 70, 72, and 74. Each of these housing may have the features discussed above. Further, housing 74 illustrates multiple female outlets 76, one per side, although these may also be on the bulb-shaped housing.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An improved extension cord light source, said improved extension cord light source comprising:

an extension cord, said extension cord having a first end with a male plug thereon and a second end for connecting to a light source, said male plug being adapted to plug into a source of power, said extension cord having at least two wires therein;

said light source, said light source being connected to said second end of said extension cord, said light source comprising:

said light source having a plurality of light devices, said light source having a housing substantially composed a durable clear material and said light source having a bulb-shaped housing, said light devices being LEDS or similar sources, said plurality of light devices being mounted in a combination of directions including radially in said light source;

an electrical means for connecting within said light source said plurality of light devices to said source of power;

at least one female power outlet, said female power outlet connected to said source of power through said wires, said at least one female power outlet being said female plug; and a pilot light device for indicating power in said light source, said pilot light device connected to said source of power through said electrical means and mounted within said housing.

2. The improved extension cord light source as defined in claim 1, further including a switch operably connected between said light devices and said source of power and adapted to provide power to said light devices to a predetermined level.

3. The improved extension cord light source as defined in claim 1, further including a removable and rotatable shade mounted to said housing.

4. The improved extension cord light source as defined in claim 3, further including a reflective material on an inside surface of said shade.

5. The improved extension cord light source as defined in claim 1, further including a female plug on said extension cord for removably mounting to a male plug within said housing.

6. The improved extension cord light source as defined in claim 2, wherein said switch has at least three setting: off, lower power and high power.

7. The improved extension cord light source as defined in claim 2, wherein said switch is a dimmer switch.

8. The improved extension cord light source as defined in claim 1, wherein said light device has one LED for illuminating a logo or other identification markings thereon.

9. The improved extension cord light source as defined in claim 1, further including said housing being substantially circular, cylindrical, or polygonal.

10. An improved extension cord light source, said improved extension cord light source comprising:

an extension cord, said extension cord having a first end with a male plug thereon and a second end with a female plug on said extension cord, said male plug being adapted to plug into a source of power, said extension cord having at least two wires therein, said extension cord having said female plug adapted to be removable from a light source;

said light source, said light source being connected to said second end of said extension cord, said light source comprising:

said light source having a plurality of light devices, said light source having a housing substantially composed a durable clear material and said light source having said housing being bulb-shaped, said light devices being LEDS or similar sources, said plurality of light devices being mounted in a combination of directions including radially in said light source;

an electrical means for connecting within said light source said plurality of light devices to said source of power;

at least one female power outlet, said female power outlet connected to said source of power through said wires, said at least one female power outlet mounted within said housing and adapted to receive power from said source of power; and a pilot light device for indicating power in said light source, said pilot light device connected to said source of power through said electrical means and mounted within said housing.

11. An improved light source for use with an extension cord, said improved light source comprising:

a light source having a plurality of light devices, said light source having a housing substantially composed a durable clear material and said light source having said housing being bulb-shaped, said light devices being LEDS or similar sources, said plurality of light devices being mounted in a combination of directions including radially in said light source;

an electrical means for connecting within said light source said plurality of light devices to a source of power;

at least one female power outlet in said housing, said at least one female power outlet mounted within said housing and adapted to be connected to a source of power by wires;

a male power outlet, said male power outlet adapted to be connected to said source of power, said male power outlet mounted within said housing being adapted for receiving power from said source of power; and a pilot light device for indicating power in said light source, said pilot light device connected to said source of power through said electrical means and mounted within said housing.

12. The improved extension cord light source as defined in claim 11, further including an adapter into which said light source may be plugged and then said adapter is screwed into an overhead light.

* * * * *